US005700179A

United States Patent [19]

Hasegawa et al.

[11] Patent Number: 5,700,179

[45] Date of Patent: Dec. 23, 1997

[54] METHOD OF MANUFACTURING SEMICONDUCTOR WAFERS AND PROCESS OF AND APPARATUS FOR GRINDING USED FOR THE SAME METHOD OF MANUFACTURE

[75] Inventors: Fumihiko Hasegawa; Makoto Kobayashi, both of Nishishirakawa-gun; Tameyoshi Hirano, Hiroshima, all of Japan

[73] Assignee: Shin-Etsu Handotai Co., Ltd., Tokyo, Japan

[21] Appl. No.: 688,173

[22] Filed: Jul. 29, 1996

[30] Foreign Application Priority Data

Jul. 28, 1996 [JP] Japan ..... 7-212508

[51] Int. Cl.[6] ..... B24B 1/00

[52] U.S. Cl. ..... 451/41; 451/190; 451/194

[58] Field of Search ..... 451/194, 43, 41, 451/44, 182, 184, 188, 190, 443, 72.56; 125/11.03, 11.01

[56] References Cited

U.S. PATENT DOCUMENTS

| | | | |
|---|---|---|---|
| 1,899,463 | 2/1933 | Howard | 451/194 |
| 2,536,444 | 1/1951 | Hamilton | 451/190 |
| 2,629,899 | 3/1953 | Aller | 451/194 |

FOREIGN PATENT DOCUMENTS

| | | |
|---|---|---|
| 362516 | 4/1990 | European Pat. Off. . |
| 412796 | 2/1991 | European Pat. Off. . |

OTHER PUBLICATIONS

Abstract of Published Japanese Patent Application No. JP 61–76262.

Abstract of Published Japanese Patent Application No. JP 63–272454.

*Primary Examiner*—Robert A. Rose

*Assistant Examiner*—George Nguyen

*Attorney, Agent, or Firm*—Evenson, McKeown, Edwards & Lenahan P.L.L.C.

[57] ABSTRACT

The invention features flattening a sliced wafer in a thin disc-like form, and chamfered if necessary, through simultaneous double side grinding by passing the wafer through between paired cylindrical grinding rolls supported at both ends in bearings, and subsequently single side polishing or double side polishing the flattened wafer to obtain a polished wafer. A lapping step and an etching step in the related art thus can be dispensed with to curtail the process time. The grinding is done by simultaneous double side grinding, so that it is free from slice mark transfer due to vacuum suction of wafer to hold the wafer, or unlike a wax mounting system it does not involve complicated operation. Furthermore, instead of batch grinding, continuous grinding can be readily made. The process is thus free from working stock removal fluctuations and permits high flatness and stable thickness to be obtained by the grinding.

20 Claims, 4 Drawing Sheets

METHOD OF MANUFACTURING SEMICONDUCTOR WAFERS AND PROCESS OF AND APPARATUS FOR GRINDING USED FOR THE SAME METHOD OF MANUFACTURE

BACKGROUND OF THE INVENTION

1. Field of the Invention

This invention relates to a method of manufacturing semiconductor wafers and as well as to a process of and an apparatus for grinding used for the same method of manufacture. More particularly, the invention relates to a method of manufacturing semiconductor wafers, which permits step reduction and efficiency increase of wafer processing with a double side grinding step introduced to replace a lapping step and an etching step, these steps being executed subsequent to a slicing step and a chamfering step in the processing of semiconductor wafer comprised semiconductor material, as well as a process of and an apparatus for grinding used for the same method of manufacture.

2. Description of the Related Art

The surface of a semiconductor wafer from which an LSI or like semiconductor device is manufactured (hereinafter referred to as wafer when in manufacturing process), is required to have high flatness, no working damage and low polishing coarseness.

In the related art, the wafer is obtained by successively performing a slicing step of obtaining a disc-like sliced wafer having a thickness of about 1,000 μm from a rod-like semiconductor (e.g., silicon) crystal, a chamfering step of grinding the top and bottom edges of the periphery of the sliced wafer, a subsequent lapping step of removing surface layers which can not be used due to surface irregularities and crystal structure disturbance generated at the time of the slicing, an etching step of chemically removing destroyed layers and layers contaminated by grinding particles remaining after the lapping step, and a polishing step of finishing the etched wafer to a mirror surface wafer.

In the lapping step, the wafer and a lapping machine are relatively moved with a slurry of a mixture of grinding particles and processing solution provided between lapping surface plate and wafer while pressurizing the wafer, whereby the wafer surface is finished to be flat with rolling of grinding particles.

The above processing is summarized as in Table 1.

TABLE 1

| Step | Working Stock Removal | Penetration Depth of Working Damage | Purpose |
|---|---|---|---|
| Slicing | 300 μm | 30 μm | Severing |
| Chamfering | 500 μm | 10 μm | Removal of edge irregularities and defects |
| Lapping | 50 μm One side | 10 μm | Flattening |
| Etching | 20 μm One side | — | Removal of destroyed layers |
| Polishing | 10 μm | — | Surface smoothing (to mirror surface) |

As is seen from Table 1, the working stock removal for the two sides in the lapping and etching steps in the related art is (50 μm+20 μm)×2=140 μm.

The lapping and etching steps, however, are done in a batch system and take considerable processing time. Besides, the working stock removal noted above fluctuates with individual batches. The considerable processing time and working stock removal fluctuations have had adverse effects on the yield and quality of the semiconductor wafers.

Therefore, it has been strongly demanded to reduce the processing time by reducing the process that is centered on the lapping and etching steps and also reduce the working stock removal fluctuations by replacing the batch system with a continuous system.

Attempts have been made to reduce the process by providing surface grinding of wafer in place of the lapping and etching steps.

A vertical grinding machine which is usually used for grinding wafers, serves to surface grind a wafer in two separate steps, i.e., steps of grinding the front and rear sides of the wafer. In such a vertical grinding machine, the wafer may be held by using a vacuum suction system having a vacuum suction board. In this case, the wafer is undesirable ground in a state that a slice mark on the side opposite the processing surface has been transferred to the processing surface.

Accordingly, in the surface grinding using the vertical grinding machine, the wafer is held by using a wax mounting system. This process, however, involves cumbersome operations and is subject to working stock removal margin fluctuations

SUMMARY OF THE INVENTION

The invention was made in view of the above problems, and it has an object of providing a method of manufacturing semiconductor wafers, which replaces the lapping and etching steps in the related art wafer processing with a double side grinding process time, can reduce not only the process but also the working stock removal fluctuations and permits replacement of the batch processing system with a continuous processing system, as well as a process of and an apparatus for grinding wafer employed for the same method of manufacture.

Another object of the invention is to provide a process of and an apparatus for grinding wafer, which permit a wafer to be held easily and reliably and permits grinding to obtain high flatness and stable thickness as pre-processing related to the polishing step.

A feature of the invention to attain the above objects, resides in flattening a sliced and optionally chamfered wafer in a thin disc-like form, through simultaneous double side grinding by passing the wafer through between paired cylindrical grinding rolls supported at both ends in bearings, and then single side polishing or double side polishing the flattened wafer to obtain a polished wafer.

According to the invention, the wafer is surface ground in lieu of the related art lapping and etching steps, thus reducing the process as a whole. In addition, the wafer is ground by simultaneous double side grinding. This means that the wafer need be held neither by a vacuum suction system using a wafer suction board nor by a wax mounting system or the like. The invention is thus free from slice mark transfer due to vacuum suction or from cumbersome operations such as in the case of the wax mounting system. Moreover, since substantially no wafer holding means is needed, continuous grinding can be readily adopted in lieu of batch grinding. It is thus possible to permit grinding to obtain high flatness and stable thickness without working stock removal fluctuations.

The wafer polishing step subsequent to the double side grinding is done as a multiple-stage mechanical/chemical composite grinding process, in which dynamic action of the mechanical polishing and chemical action of the etching are compounded to obtain highly accurate polished surface with high efficiency as a compounded effect. It is possible to adopt either single side polishing or double side polishing.

In the simultaneous double side grinding process, a sliced and optionally chamfered wafer in a thin disc-like form is flattened through simultaneous double side grinding by passing the wafer through paired cylindrical grinding rolls supported at both ends in bearings. In this process, the cylindrical grinding rolls may be flexed by passing the wafer through between them, particularly in the case where the wafer is ground greatly.

In one grinding process according to the invention, rigid rolls are provided such that they are in contact with the back side of the respective cylindrical grinding rolls over the entire length thereof, thus preventing the cylindrical grinding rolls from flexing during wafer grinding time with the contact pressures of the rigid rolls. (This grinding process is hereinafter referred to as the first grinding process.)

Continuous double side grinding is thus possible, which can ensure high flatness and stable grinding thickness.

In this case, the direction of grinding wafer may be set to be the same as the wafer feed direction to permit forward feed grinding with a great extent of grinding. Doing so permits a predetermined grinding thickness to be obtained by one-pass grinding (i.e., grinding in one direction only).

The rigid rolls on the back side of the cylindrical grinding rolls may be rotated with a peripheral speed difference provided with respect to the peripheral speed of the grinding rolls, thus permitting sliding of the cylindrical grinding rolls for grinding surface regeneration thereof such as dressing or trueing.

In such first grinding process, in which rigid rolls (which serve as backing rolls) are provided on the back side of the cylindrical grinding rolls, the rigidity thereof can be increased. In addition, the rigid rolls may be used as a mechanism for correcting the grinding surfaces of the grinding wheels, thus permitting more continuous trueing and dressing during grinding as well. Long-time continuous grinding of wafers carried by a carrier is thus possible. Besides, highly accurate double side grinding by forward feed grinding may be done continuously in a one-pass operation.

It is possible to obtain grinding of a wafer without the rigid rolls. This grinding process comprises flattening a sliced and optionally chamfered wafer in a thin disc-like form through simultaneous double side grinding by passing the wafer through between paired cylindrical grinding rolls supported at both ends in bearings, holding one of the cylindrical paired grinding rolls stationary, while making the other grinding roll movable toward and away from the afore-said one grinding roll, and setting the direction of grinding of the wafer to be opposite to the wafer feed direction for against-feed grinding. (This grinding process is hereinafter referred to as the second grinding process.)

The against-feed grinding, although the working stock removal is less, permits prevention of the flexing during grinding of the cylindrical grinding rolls without use of rigid rolls (i.e., backing rolls), thus ensuring high flatness and stable grinding thickness.

This grinding process permits the grinding surface regeneration of the grinding rolls, such as dressing or trueing, to be obtained with sliding of the grinding rolls over each other. For example, the grinding surface regeneration of the both grinding rolls is suitably done at a suitable time during a non-grinding period by moving the movable grinding roll in the axial direction of the other, i.e., stationary grinding roll while in contact with the periphery thereof.

Thus, with the second grinding process it is possible to obtain high speed continuous double side grinding by against-feed grinding (in which the grinding rolls are rotated in the opposite direction to the direction of movement of the work) with the grinding stock removal held within a small value. Thus, although it is necessary to repeat the process a plurality of times for securing a predetermined working stock removal, like the first grinding process it is possible reduce the lapping and etching steps in the related art batch system to a single double side grinding step, while reducing and uniformalizing the working stock removal (i.e., total working stock removal in this case). Thus, grinding efficiency improvement and highly accurate grinding can be obtained.

In either of the above grinding process, continuous automatic grinding is readily obtainable by passing the wafer in a state of being carried by a belt-like wafer carrier, which has a thickness smaller than the clearance between the cylindrical grinding rolls, through the clearance therebetween via carrier for the simultaneous double side grinding.

Suitably, the paired cylindrical grinding rolls and the paired rigid rolls provided on the back side of the paired cylindrical grinding rolls, are disposed such that their axes are horizontal and lie in a vertical plane.

The forward feed grinding is possible by setting the direction of rotation of the cylindrical grinding rolls to be the same as the wafer feed direction.

By rotating the rigid rollers provided on the back side of the cylindrical grinding rolls such as to provide a peripheral speed difference with respect to the peripheral speed of the grinding rolls, grinding surface regeneration can be obtained with the rigid rolls.

An apparatus corresponding to the second grinding process, is a simultaneous double side grinding apparatus for flattening a sliced and optionally chamfered wafer in a thin disc-like form through simultaneous double side grinding by passing the wafer through between paired cylindrical grinding rolls supported at both ends in bearings, one of the grinding rolls being held stationary, the other grinding roll being made movable toward and away from the afore-said one grinding roll, the direction of rotation of the cylindrical grinding rolls being set to be opposite to the wafer feed direction.

The afore-said other grinding roll which is movable toward and away from the afore-said one grinding roll, may be mounted together with a mechanism for moving it on movable means movable in the axial directions of the grinding rolls. This arrangement permits grinding surface regeneration of both grinding rolls to be made at a suitable non-grinding time by causing movement of the movable grinding roll in the axial direction thereof while in contact with the periphery of the stationary grinding roll.

In either of the above grinding processes, continuous grinding can be readily obtained with a grinding apparatus, which comprises a belt-like wafer carrier for carrying a wafer received therein, the wafer carrier having a thickness smaller than the clearance between the grinding rolls, and carrier guides disposed respectively upstream and downstream of the prior pairs cylindrical grinding rolls and positioned to permit movement of the carrier only in a direction perpendicular to the axes of the grinding rolls.

In either of the above apparatuses, clearance setting means for setting the clearance between the pair cylindrical grinding rolls is suitably provided at least on a movable part side of either of the grinding rolls for accurately setting the clearance.

Figure 1:
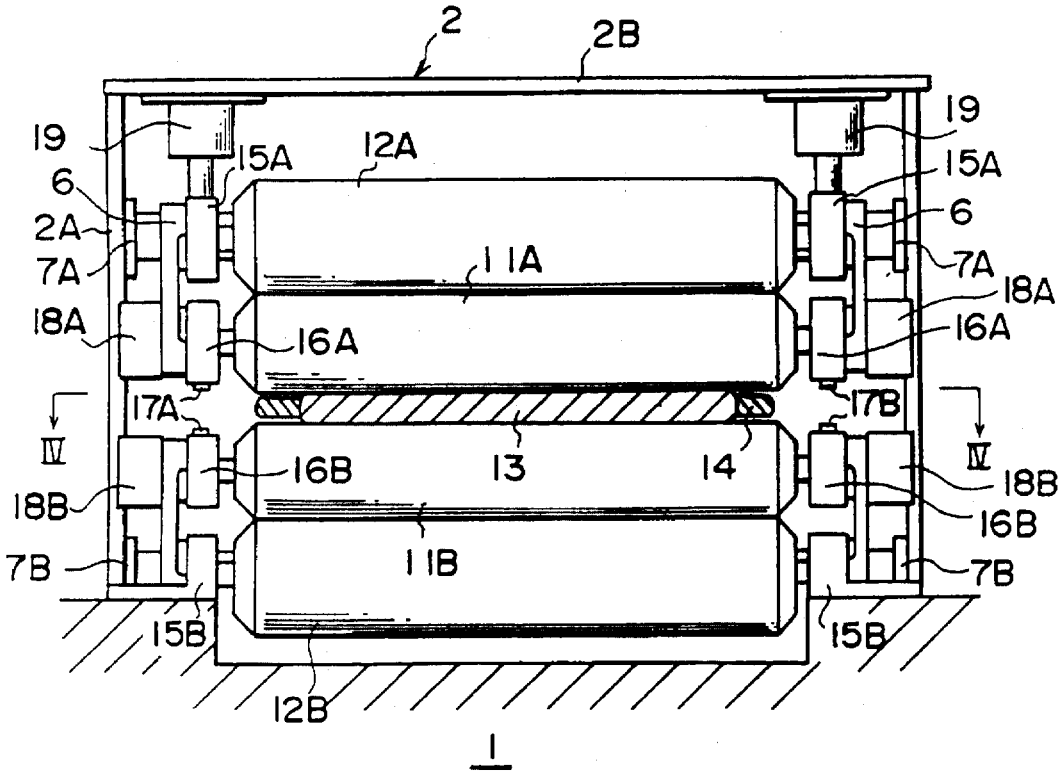
FIG. 1 is a front view showing a double side grinding apparatus with cylindrical grinding rolls as a first embodiment of the invention.

As reference numerals designating main parts shown in the Figures: 11 . . . grinding roll, 12 . . . backing roll, 13 . . . wafer, 14 . . . carrier, 17 . . . sensor, 19, 22 . . . clearance setting mechanism, 20 . . . carrier guide, 21 . . . linear guide

DETAILED DESCRIPTION OF THE PREFERRED EMBODIMENTS

Preferred embodiments of the invention will now be described with reference to the accompanying drawings. Unless particularly specified, the sizes, shapes, relative positions, etc. of the constituent parts in the embodiments are not intended to limit the scope of the invention but are merely exemplary.

Figure 2:
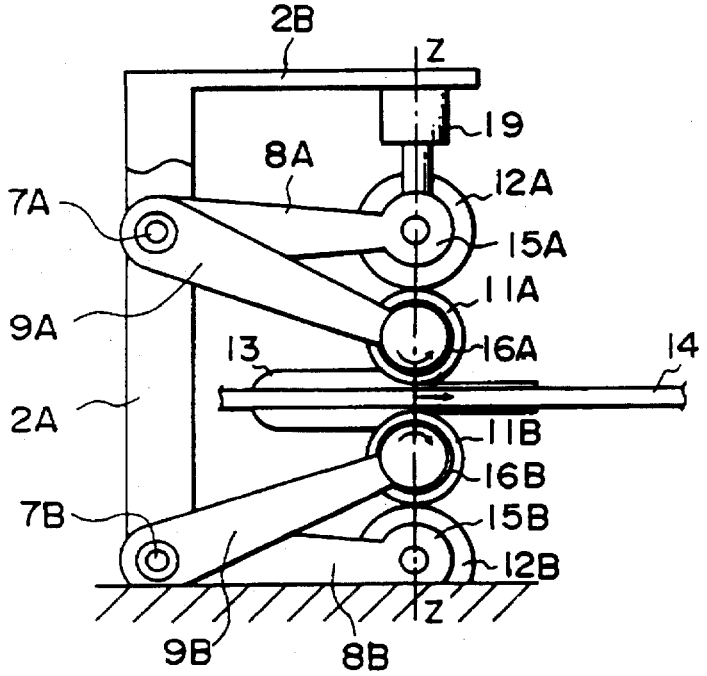
FIG. 2 is a side view showing the apparatus shown in FIG. 1.
Figure 3:
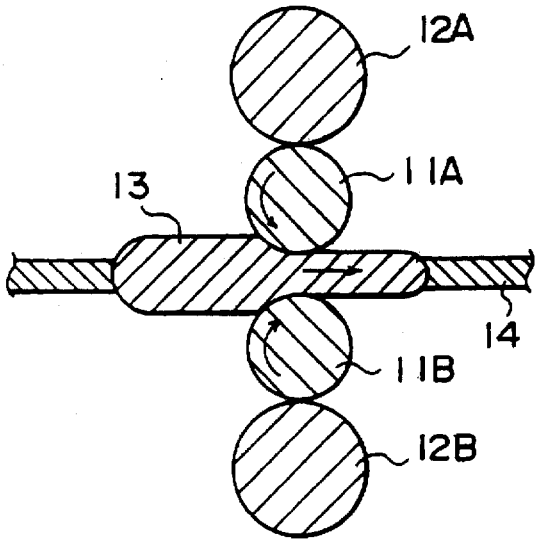
FIG. 3 is a view illustrating the status of creep feed double side grinding by work feed direction grinding in the double side grinding apparatus shown in FIG. 1.
Figure 4:
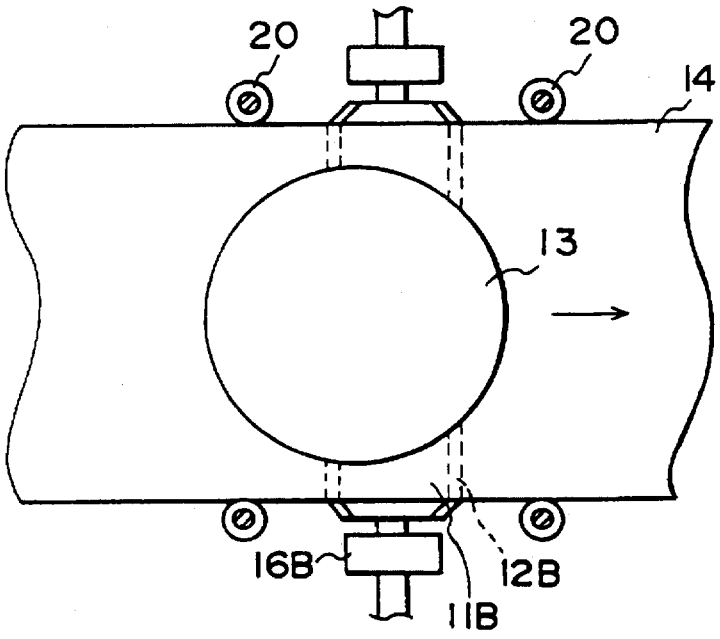
FIG. 4 is a sectional view taken along line IV—IV in FIG. 1 illustrating the wafer feed status.

FIG. 1 is a front view showing a wafer double side grinding machine with cylindrical grinding rolls according to a first embodiment of the invention. FIG. 2 is a side view showing the grinding machine. FIG. 3 is a view illustrating creep feed double side grinding by work feed direction grinding in the grinding machine shown in FIG. 1. FIG. 4 is a view taken along line IV—IV in FIG. 1 illustrating wafer feeding status.

Referring to FIG. 1, a wafer double side grinding machine is shown installed on a base 1. The grinding machine comprises a pair of cylindrical highly rigid grinding rolls 11A and 11B, which are each supported at both ends in bearings 16A and 16B. The grinding rolls 11A and 11B extend horizontally and are aligned in a vertical plane so that they face each other, and they can be driven by their drives 18A and 18B for rotation at variable speed.

A backing roll 12A is provided on the top (i.e., back side) of the upper cylindrical grinding roll 11A, and another backing roll 12B is provided on the bottom (i.e., back side) of the lower cylindrical grinding roll 11B. These backing rolls 12A and 12B have the length of the grinding rolls 11A and 11B, and are each supported at both ends in bearings 15A and 15B.

The backing rolls 12A and 12B are made of a super-hard alloy or steel or a ceramic-clad rigid material.

The bearings 15A and 16A are supported on the free ends of arms 8A and 9A, which have their other ends pivoted to opposite side support posts 2A of a housing by axes 7A.

Likewise, the bearings 15B and 16B are supported on the free ends of arms 8B and 9B, which have their other ends pivoted to the opposite side support posts 2A of the housing by axes 7B.

The grinding rolls 11A and 11B are thus backed up with axially uniform pressure by their back side backing rolls 12A and 12B which are the same length as the grinding rolls.

The cylindrical grinding rolls 11A and 11B and backing rolls 12A and 12B are highly rigid both statically and dynamically while they are supported at both ends, and thus they permit grinding with a large depth of cut as shown in FIG. 1 and 2.

The axes of the backing rolls 12A and 12B and cylindrical grinding rolls 11A and 11B lie in a vertical plane as shown by line z—z in FIG. 2.

On a ceiling 2B of the housing 2, clearance setting mechanism 19 is mounted for setting the clearance between the grinding rolls 11A and 11B. The clearance setting mechanism 19 is adapted to have its free end in contact with the top of each of the bearings 15A of the backing roll 12A to position and secure the backing rolls 12A at a given position. The bearings 16A and 16B of the grinding rolls 11A and 11B have clearance sensors 17A and 17B for detecting the clearance between the grinding rolls 11A and 11B. It is thus possible to accurately detect the clearance between the grinding rolls 11A and 11B as set by the clearance setting mechanism 19, i.e., the grinding thickness of the wafer 13.

As shown in FIGS. 3 and 4, a belt-like wafer carrier 14 having a hole for supporting a work wafer received therein, is disposed between the cylindrical grinding rolls 11A and 11B such that it can be guided by roll-like carrier guides 20 disposed on the opposite sides of the cylindrical grinding rolls 11A and 11B as pairs each on each side of it for running in a direction of arrow perpendicular to the grinding roll axes. By causing the work wafer 13 that is fitted in and carried by the wafer carrier 14 to run with the wafer carrier 14 in the direction of the arrow, the wafer 13 can be ground continuously in a single pass. In this pass, both the front and rear sides of the work wafer are simultaneously subjected to forward feed grinding with a large depth of cut by work feed direction grinding.

According to this embodiment, the backing rolls 12A and 12B back up the cylindrical grinding rolls 11A and 11B from the back side thereof and in synchronous rotation thereto with an axially uniform pressure. Thus, one pass and great cut depth grinding can be done without flexing deformation of the grinding rolls against the grinding pressure, that is, without resulting in a greater thickness central portion of wafer. In other words, it is possible to obtain very high flatness grinding and reduce grinding stock removal fluctuations compared to the prior art.

Uniform thickness and high flatness grinding thus can be obtained by a single grinding step in place of the conventional two-step process comprising the lapping step and the etching step.

In addition, unlike the prior art both the front and rear sides of wafer can be ground simultaneously instead of grinding each side separately from the other. Moreover, the double side grinding can be made continuously by merely causing the belt-like wafer carrier supporting the wafer received therein to run through the paired cylindrical grinding rollers in the one-pass direction.

As the grinding rolls, rolls are used having a chip pocket as a space, which can promote flow of grinding solution into it and permit cutting chips to be smoothly carried out of the grinding zone. As the grinding solution, an aqueous low temperature grinding solution can be supplied in large amount and under high pressure from a grinding solution feeder (not shown).

For the running of the wafer carrier 14 carrying the work wafer 13, suitably a mechanism using carrier 14 with high rigidity is used to permit stable cut.

The apparatus has a symmetrical mechanical structure, which can suppress stress due to thermal deformation to prevent grinding accuracy reduction due to vibrations and thermal stress.

The apparatus further has a grinding surface regeneration mechanism. In this embodiment, the backing rolls 12A and 12B which are provided on the back side of the cylindrical grinding rolls 11A and 11B, are made of steel and are capable of being braked by braking means 6 to produce a peripheral speed difference with respect to the cylindrical grinding rolls 11. The backing rolls 12A and 12B are thus operable as crash rolls sliding over the outer periphery of the cylindrical grinding rolls 11A and 11B to permit continuous trueing and dressing, i.e., regeneration of the grinding surfaces of the grinding rolls.

When carrying out the trueing and dressing, the backing rolls may be made to serve as the crash rolls for a predetermined period of non-grinding time for every predetermined number of work wafers 13 by counting the number of work wafers 13 ground. Alternatively, the clearance setting mechanism 19, 19 may be adapted to have the backing rolls 12A and 12B contact the paired cylindrical grinding rolls 11A and 11B with an adequate pressure for the clearance setting, with backing rolls 12A and 12B being thus braked to produce a peripheral speed difference with respect to the grinding rolls 11A and 11B during the wafer carrier running time during wafer grinding times. In this way, the grinding surfaces of the grinding rolls can be quickly regenerated in a short time.

Figure 5:
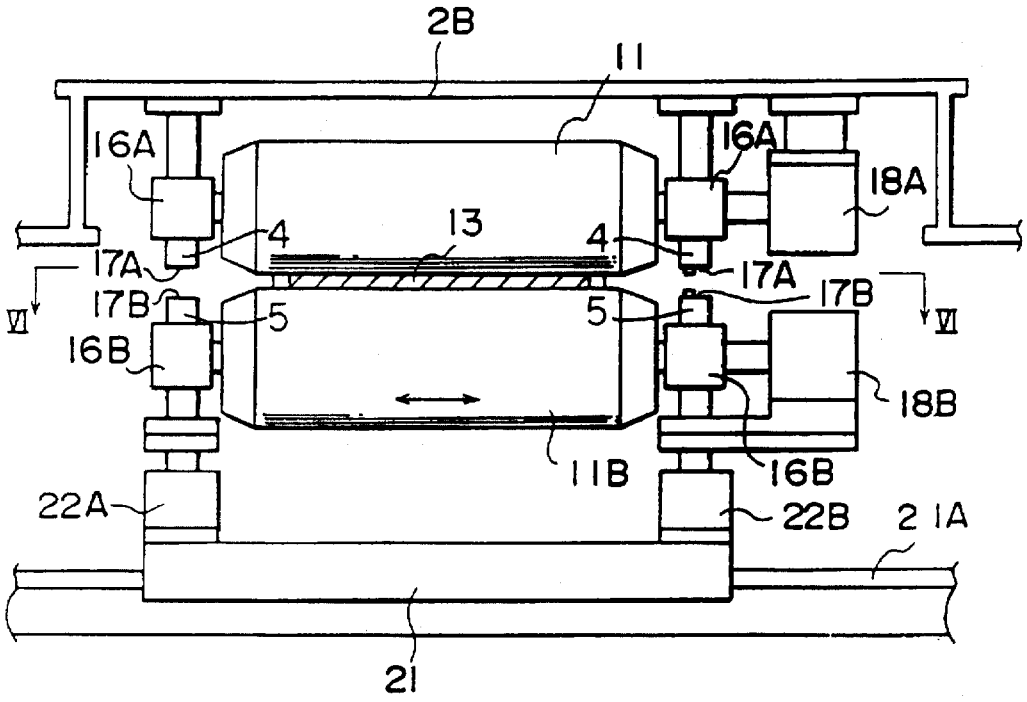
FIG. 5 is a front view showing a double side grinding apparatus with cylindrical grinding rolls as a second embodiment of the invention.

FIG. 5 shows a structure according to a second embodiment of the invention, in which the backing rolls 12A and 12B are dispensed with. As shown, the structure comprises an upper and a lower cylindrical grinding roll 11A and 11B, the axes thereof lying in a vertical plane and extending horizontally. The grinding rolls 11A and 11B are supported respectively at both ends by bearings 16A and 16B and are rotatable by their drives 18A and 18B at variable speed.

The upper cylindrical grinding roll 11A is reliably vertically positioned and secured via the bearings 16A by upper vertical supports 4 depending from a ceiling 2B of a housing.

The lower cylindrical grinding roll 11B is supported at both ends via the bearings 16B by lower vertical supports 5 erected upright from a vertically movable clearance setting mechanism 22A, 22B. The clearance setting mechanism 22A, 22B is mounted on a linear guide 21 which is movable along a guide rail 21A extending in the axial direction of the grinding rolls 11A and 11B.

Figure 8:
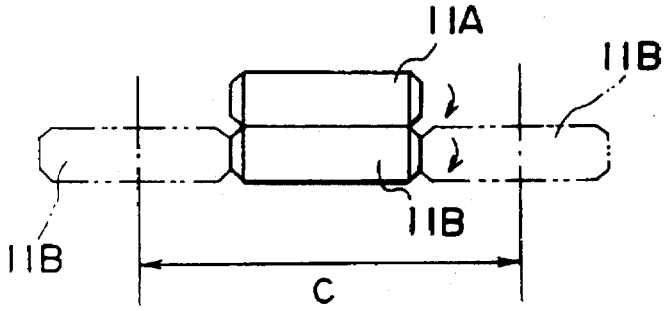
FIG. 8 is a view briefly showing a grinding surface regeneration mechanism in the double side grinding apparatus shown in FIG. 5.

Clearance sensors 17A and 17B are provided on the ends of the upper and lower vertical supports 4 and 5 that face one another to detect the grinding clearance between the grinding rolls 11A and 11B that is controlled by the clearance setting mechanism 22A, 22B. The grinding clearance for the work wafer 13 thus can be provided accurately. The lower cylindrical grinding roll 11B can be moved axially along the linear guide 21 so that it can be moved to the left or right from the grinding position as shown in FIG. 8.

Figure 6:
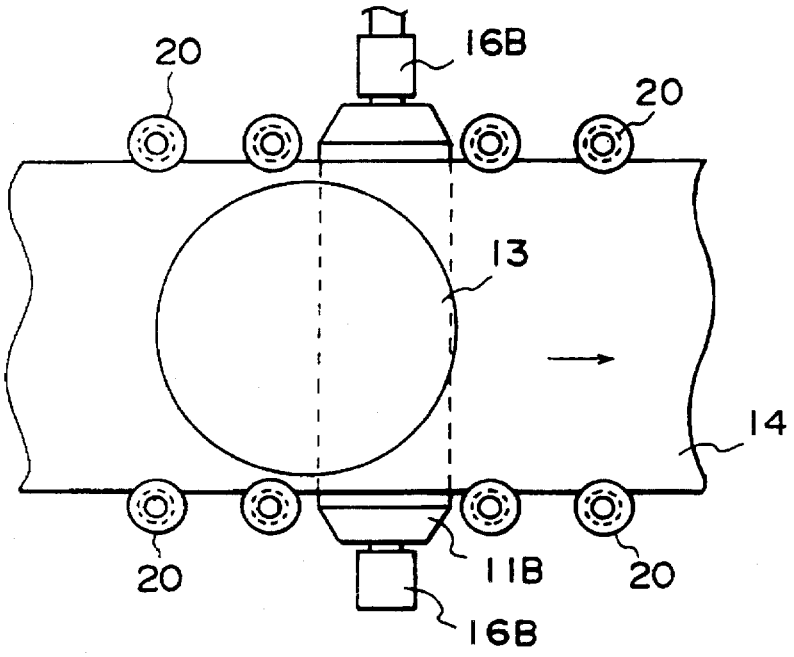
FIG. 6 is a sectional view taken along line VI—VI in FIG. 5 illustrating the wafer feed status.

Like the previous embodiment, the wafer 13, as shown in FIG. 6, can run with a belt-like wafer carrier 14, which is guided by roller-like carrier guides 20 while it runs between the paired grinding rolls 11A and 11B in the direction of the arrow (i.e., a direction perpendicular to the direction of the grinding roll axes).

Thus, as the wafer 13 is passed with the wafer carrier 14 through the cylindrical grinding rolls 11A and 11B, and the opposite sides of the wafer 13 are ground simultaneously while a grinding solution is supplied under high pressure from a grinding solution feeder (not shown).

This second embodiment shown in FIG. 5, unlike the first embodiment, is free from any backing roll. Therefore, the flexing rigidity of the cylindrical grinding rolls is low, and great load can not be applied during grinding.

Figure 7:
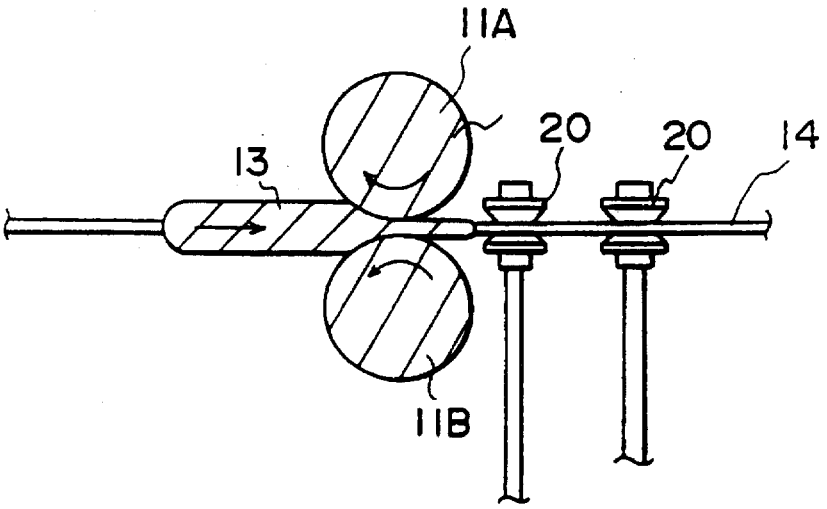
FIG. 7 is a view illustrating the status of double side grinding by against-feed direction grinding in the double side grinding apparatus shown in FIG. 5.

Accordingly, as shown in FIG. 7, the work wafer 13 is ground by anti-work feed direction grinding. In this way, the grinding stock removal is held within about 0.1 to 1 μm, while the wafer carrier 14 is moved at a high speed.

This embodiment without any backing roll also has a grinding surface regeneration mechanism for the grinding roll. As shown in FIG. 8, after the paired cylindrical grinding rolls 11A and 11B are brought into contact with each other with an adequate pressure by raising the clearance setting mechanism 22A, 22B, the cylindrical grinding rolls 11A and 11B are rotated, for instance in the same direction of rotation, such as to provide for a peripheral speed difference between them, and the lower grinding roll 11B is axially reciprocated with the linear guide 21 along the guide rail 21A to the left and right with a stroke as shown by arrow C. In this way, desired trueing and dressing can be quickly obtained in a short time.

The grinding surface regeneration of the grinding rolls is suitably carried out whenever the wafer grinding has been done a plurality of times.

As has been described in the foregoing with the first embodiment shown in FIGS. 1 to 4, it is possible to obtain continuous grinding roll regeneration as well. This means that it is possible to permit forward feed grinding with a great depth of cut by work feed direction grinding as well as simultaneous grinding of both sides of the wafer. A stable quality of product wafer is thus obtainable, which has high flatness on both front and rear sides and is free from thickness fluctuations.

More specifically, it is possible to reduce the two-step process comprising the lapping step and the etching step in the prior art to a one-pass step, while permitting continuous simultaneous double side grinding, i.e., grinding of both the front and rear sides at a time. It is thus possible to increase the processing efficiency and reduce fluctuations of product due to continuous grinding, thus greatly contributing not only to the improvement of the yield of process but also to the yield of materials due to reduction of working stock removal.

With the second embodiment shown in FIGS. 5 to 8, it is possible to permit continuous simultaneous double side grinding by anti-work feed direction grinding with a small depth of cut, thus providing for reduction of the step and reduction of the grinding stock removal as in the first embodiment.

What is claimed is:

1. A method of processing a semiconductor wafer comprising the steps of:

flattening a thin, disc-like, sliced wafer by simultaneously grinding both sides of the wafer by passing the wafer between paired cylindrical grinding rolls supported at both ends in bearings, and thereafter polishing the flattened wafer on at least one side to obtain a polished wafer.

2. A method according to claim 1, wherein said wafer is polished on both sides.

3. A process of grinding a wafer comprising the steps of:

flattening a thin, disc-like, sliced wafer by simultaneously grinding both sides of the wafer by passing the wafer between paired cylindrical grinding rolls supported at both ends in bearings; and simultaneously backing up the paired cylindrical grinding rolls with rigid rolls held in contact with the back side of the pairs cylindrical grinding rolls over the entire length thereof to prevent flexing of the cylindrical grinding rolls during grinding of the wafer with contact pressures applied by the rigid rolls.

4. A process according to claim 3, wherein said wafer is a chamfered wafer.

5. A process according to claim 3, wherein the wafer is passed between the paired grinding rolls in the grinding direction of the rolls.

6. A process according to claim 3, wherein the grinding surfaces of the cylindrical grinding rolls are regenerated by rotating the rigid rolls which back up the grinding rolls at a peripheral speed which differs from that of the grinding rolls.

7. A process according to claim 3, wherein the wafer is ground simultaneously on both sides by passing the wafer through a clearance between the grinding rolls, said wafer being carried by a belt-like wafer carrier which has a thickness smaller than the clearance between the grinding rolls.

8. A process for grinding a semiconductor wafer comprising flattening a thin, disc-like, sliced wafer by simultaneously grinding both sides of the wafer by passing the wafer in a wafer feed direction between paired cylindrical rotating grinding rolls supported at both ends in bearings, one of said rotating grinding rolls being held in a fixed location and the other of the rotating grinding rolls being selectively movable toward and away from said one grinding roll, said rotating grinding rolls being rotated in a direction such that surfaces of the rolls which contact the wafer move opposite said wafer feed direction.

9. A process according to claim 8, wherein said wafer is a chamfered wafer.

10. A process according to claim 8, wherein grinding surfaces of the grinding rolls are regenerated at a time when no wafer is being ground by moving said other grinding roll toward said one grinding roll until the grinding rolls are in contact with each other, and then moving said other grinding roll axially while in contact with said one grinding roll.

11. A process according to claim 8, wherein the wafer is ground simultaneously on both sides by passing the wafer through a clearance between the grinding rolls, said wafer being carried by a belt-like wafer carrier which has a thickness smaller than the clearance between the grinding rolls.

12. An apparatus for simultaneously grinding both sides of a semiconductor wafer, said apparatus comprising:

a pair of rotatable cylindrical grinding rolls supported at both ends in bearings;

a pair of rigid backing rolls, each backing roll being in contact with a back side of a respective one of said grinding rolls over the entire length of the respective grinding roll; and means for passing a sliced wafer in a wafer feed direction through a clearance between said grinding rolls.

13. An apparatus according to claim 12, wherein said grinding rolls are rotated such that surfaces of the grinding rolls which contact the wafer move in the wafer feed direction.

14. An apparatus according to claim 12, wherein the cylindrical grinding rolls and the rigid backing rolls all rotate about horizontal axes disposed in a common vertical plane.

15. An apparatus according to claim 12, further comprising means for producing a peripheral speed difference between the backing rolls and the respective grinding rolls.

16. An apparatus according to claim 12, wherein said means for passing a sliced wafer between the grinding rolls comprises a belt-like wafer carrier for carrying a wafer received therein, and a plurality of carrier guides disposed upstream and downstream of the grinding rolls, said carrier guides being positioned to permit movement of the carrier only in a direction perpendicular to the axes of the grinding rolls, and said wafer carrier having a thickness smaller than the clearance between the grinding rolls.

17. An apparatus for simultaneously grinding both sides of a semiconductor wafer, said apparatus comprising:

a pair of rotatable cylindrical grinding rolls supported at both ends in bearings, one of said grinding rolls being held in a fixed location, and the other of said grinding rolls being selectively movable radially toward and away from said one grinding roll; and means for passing a sliced wafer in a wafer feed direction through a clearance between the cylindrical grinding rolls;

said grinding rolls being rotated such that surfaces of the grinding rolls which contact the wafer move opposite the wafer feed direction.

18. An apparatus according to claim 17, wherein said other of said grinding rolls is also movable axially relative to said one of said grinding rolls.

19. An apparatus according to claim 17, wherein said means for passing a sliced wafer between the grinding rolls comprises a belt-like wafer carrier for carrying a wafer received therein, and a plurality of carrier guides disposed upstream and downstream of the grinding rolls, said carrier guides being positioned to permit movement of the carrier only in a direction perpendicular to the axes of the grinding rolls, and said wafer carrier having a thickness smaller than the clearance between the grinding rolls.

20. An apparatus according to claim 17, further comprising a movable clearance setting mechanism on at least one side of one grinding roll, said clearance setting mechanism positioning the one grinding roll to regulate the clearance between the grinding rolls.

* * * * *

UNITED STATES PATENT AND TRADEMARK OFFICE

CERTIFICATE OF CORRECTION

PATENT NO. : 5,700,179

DATED : December 23, 1997

INVENTOR(S) : Fumihiko HASEGAWA et al.

It is certified that error appears in the above-identified patent and that said Letters Patent is hereby corrected as shown below:

On the title page, item [30]:

Change the Foreign Application Priority Data from

"Jul. 28, 1996 [JP] Japan ... 7-212508"

to

--Jul. 28, 1995 [JP] Japan ... 7-212506--.

Signed and Sealed this

Twenty-third Day of February, 1999

*Attest:*

Q. TODD DICKINSON

*Attesting Officer*

*Acting Commissioner of Patents and Trademarks*